United States Patent [19]

Bladykas

[11] 4,236,675

[45] Dec. 2, 1980

[54] PROCESS AND APPARATUS FOR PRODUCING STOCKPILEABLE ASPHALTIC CONCRETE

[76] Inventor: Theodore S. Bladykas, 1493 Poulson St., Wantagh, N.Y. 11793

[21] Appl. No.: 834,520

[22] Filed: Sep. 19, 1977

[51] Int. Cl.[3] ..... B02C 23/18

[52] U.S. Cl. ..... 241/65; 106/278; 106/279; 106/281 R; 106/287.1; 241/101.7; 241/224

[58] Field of Search ..... 241/17, 27, 65, 187, 241/227, 235, 101.7, 222, 224, 221; 106/281, 283, 278–279, 287 SB

[56] References Cited

U.S. PATENT DOCUMENTS

| | | | |
|---|---|---|---|
| 1,954,997 | 4/1934 | Hirzel | 106/281 |
| 3,305,474 | 2/1967 | Knowles et al. | 106/283 |
| 3,707,266 | 12/1972 | Llabres | 241/187 |

FOREIGN PATENT DOCUMENTS

| | | | |
|---|---|---|---|
| 1008093 | 5/1957 | Fed. Rep. of Germany | 241/187 |

OTHER PUBLICATIONS

"Design and Construction of Asphaltic Roads and Streets" The Asphalt Institute, 1952.

*Primary Examiner*—J. Ziegler

[57] ABSTRACT

Hot-mix asphaltic concrete is fed from a supply hopper, located off-center above one end of a coolant tank containing a coolant bath, on to a rotating vaned projecting drum. Sheets of asphaltic concrete, the thickness of which are controlled by the clearance between the shearing edge of the supply hopper and the vaned projecting drum, are formed and projected above the coolant bath toward the opposite side of the coolant tank against a dispersing drum rotating in a direction opposite to that of the vaned projecting drum about an axis of rotation substantially parallel to that of the projecting drum. The sheets of asphaltic concrete are broken into particles and deflected through the coolant bath towards an endless conveyer. The particles, which are collected by the endless conveyer, are further cooled by the coolant bath as they are conveyed to the opposite end of the coolant tank and discharged.

6 Claims, 3 Drawing Figures

PROCESS AND APPARATUS FOR PRODUCING STOCKPILEABLE ASPHALTIC CONCRETE

BACKGROUND OF THE INVENTION

The invention is especially suited for use in a process and apparatus for producing particles of stockpileable asphaltic concrete from hot-mix asphaltic concrete and will be described in that connection.

Heretofore, one of two methods of repairing defective road beds have been employed. In one method a cutback asphaltic concrete is used. Cutback asphaltic concrete is a mixture of sand and stones, usually referred to as aggregates, with cutback asphalt cement as a binder. Cutback asphalt cement is one which has been rendered liquid at normal atmospheric temperatures by mixing it with cutback agents such as naphtha or kerosene. Such cutback agents are necessary to maintain workability of the material and to allow it to remain loose in a stockpile. This is what is meant by the term "stockpileable" as it is used in this specification and in the appended claims. A stockpileable material is one which remains loose and workable and does not fuse into a large, hard, agglomerate mass, at normal atmospheric temperatures.

With respect to cutback asphaltic concrete, the presence of cutback agents, required to make the concrete workable at normal atmospheric temperatures, also serves to weaken the material. Thus, cutback asphaltic concrete is easily displaced by traffic and its use permits only temporary repair of road beds.

The second method of repairing road beds utilizes hot-mix asphaltic concrete. Hot-mix asphaltic concrete also consists of a combination of aggregates coated with asphalt cement, however, no cutback agents are used; heat is employed to maintain workability. Both the aggregate and the asphalt cement are heated prior to mixing to dry the aggregate and obtain sufficient fluidity of the asphalt cement for proper mixing and workability: hence the term "hot-mix". Thus, hot-mix asphaltic concrete is only workable when hot. If it cools it becomes hard and unworkable; this results in much waste.

The term "asphaltic concrete" as used in this specification and in the appended claims does not include cutback asphaltic concrete (i.e., any asphaltic concrete utilizing a cutback agent to maintain workability at normal atmospheric temperatures). The manual on "Design and Construction of Asphaltic Roads and Streets" published by The Asphalt Institute in 1952 defines asphaltic cement as "a refined asphalt which must be heated for use and must be used with hot sand and rock". This clearly excludes cutback asphaltic cements as they do not depend on heat for workability.

The stockpileable asphaltic concrete of this invention remains workable at normal atmospheric temperatures without cutting agents by virtue of the unique process of manufacture disclosed by this specification. It is used, as needed, in whatever quantity required. To make a permanent repair the material is spread to the desired level and heat is applied by torch, hot iron or preferably by infra-red waves. The application of heat causes the stockpileable asphaltic concrete of this invention to revert to its original state as hot-mix asphaltic concrete. There is no substantial waste as unheated portions of the particulate material can be returned to the stockpile for later use. The stockpileable asphaltic concrete of this invention will not rejoin into an unworkable mass so long as the stockpile temperature does not exceed 120° F.

It is an object of this invention, therefore, to provide a new and improved stockpileable asphaltic concrete which obviates the above-mentioned disadvantages of prior art materials.

It is another object of this invention to provide a new process for making stockpileable asphaltic concrete.

It is a further object of this invention to provide apparatus for producing stockpileable asphaltic concrete.

SUMMARY OF THE INVENTION

In accordance with this invention there is provided a process for producing stockpileable asphaltic concrete from hot-mix asphaltic concrete, comprising: dispersing hot-mix asphaltic concrete into a coolant bath so as to form particles of asphaltic concrete and cool such particles; and discharging the particles of asphaltic concrete from the coolant bath.

In accordance with this invention there is also provided a stockpileable asphaltic concrete.

In accordance with this invention there is further provided apparatus for producing stockpileable asphaltic concrete from hot-mix asphaltic concrete comprising a coolant tank for containing a coolant bath; means for dispersing the hot-mix asphaltic concrete into the coolant tank to form particles of asphaltic concrete; and means for discharging the particles of asphaltic concrete from the coolant tank.

For a better understanding of the present invention, together with further objects and features thereof, reference is had to the following description, to be read in conjunction with the accompanying drawings, wherein like components in the several views are identified by the same reference numeral, while its scope will be pointed out in the appended claims.

DESCRIPTION OF THE PREFERRED EMBODIMENT

Figure 1:
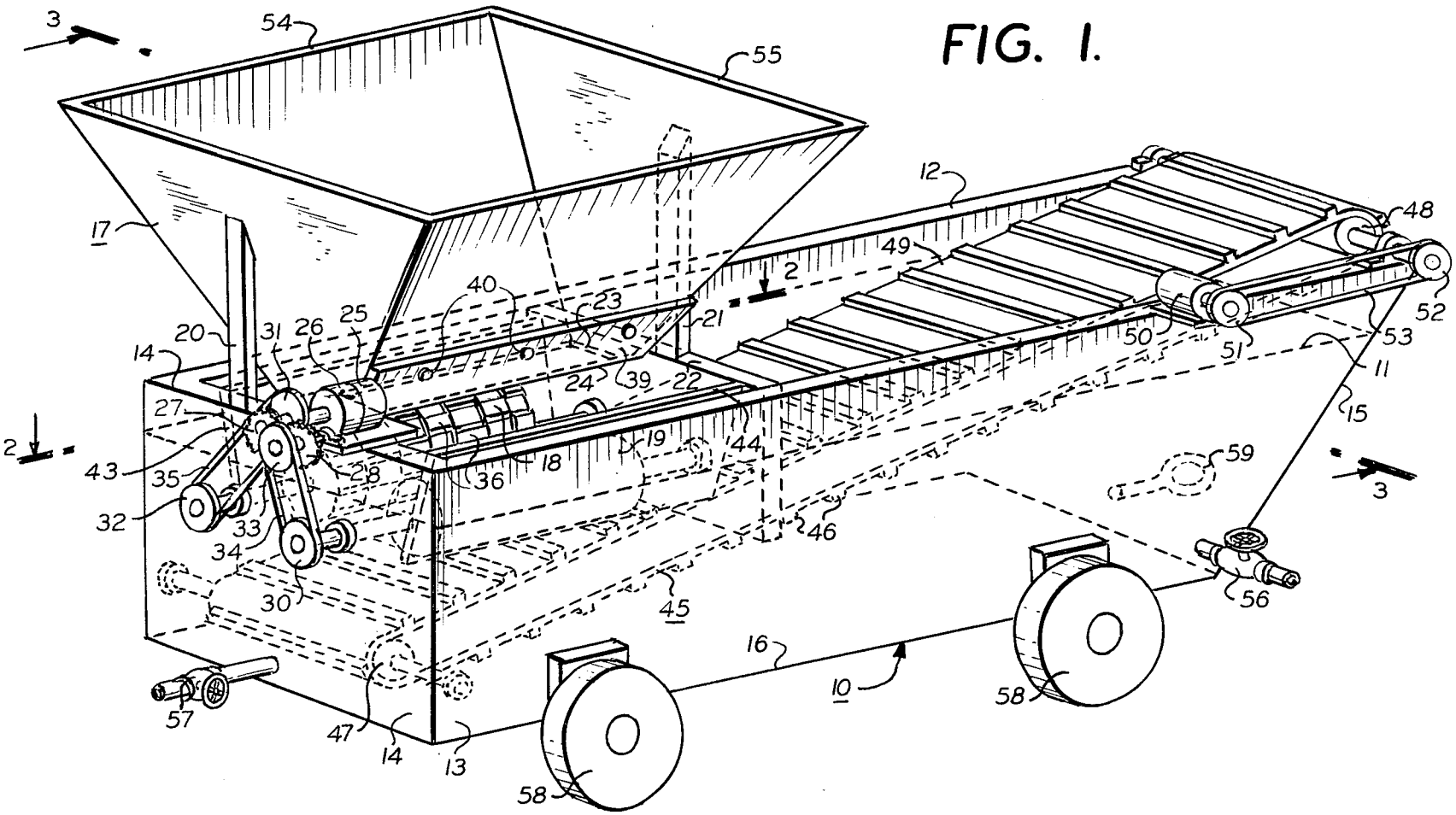
FIG. 1 is a perspective side view of the apparatus for producing stockpileable asphaltic concrete.

Referring more specifically to the drawings, FIG. 1 illustrates apparatus for producing stockpileable asphaltic concrete from hot-mix asphaltic concrete. In the preferred embodiment coolant tank 10, which may be any suitable means for containing coolant bath 11, has sides 12 and 13, feed-end 14, discharge-end 15 and upwardly facing bottom 16. Sides 12 and 13 and feed-end 14 are vertical while discharge-end 15 slants upwardly and outwardly.

The apparatus of the invention further includes means for dispersing the hot-mix asphaltic concrete into coolant tank 10. This means is shown as supply hopper 17, vaned projecting drum 18, dispersing drum 19 and means for driving vaned projecting drum 18 and dispersing drum 19 in opposite rotational directions.

Supply hopper 17 is supported by brackets 20 and 21 attached to the upper edges of coolant tank 10 and cross-support 22, respectively. Vaned projecting drum 18 and dispersing drum 19 are rotatably mounted between feed-end 14 of coolant tank 10 and cross-support 22. Vaned projecting drum 18 is located directly below output port 23 of supply hopper 17. The axes of rotation of vaned projecting drum 18 and dispersing drum 19 are in the same horizontal plane and substantially parallel to shearing edge 24 of output port 23.

Figure 2:
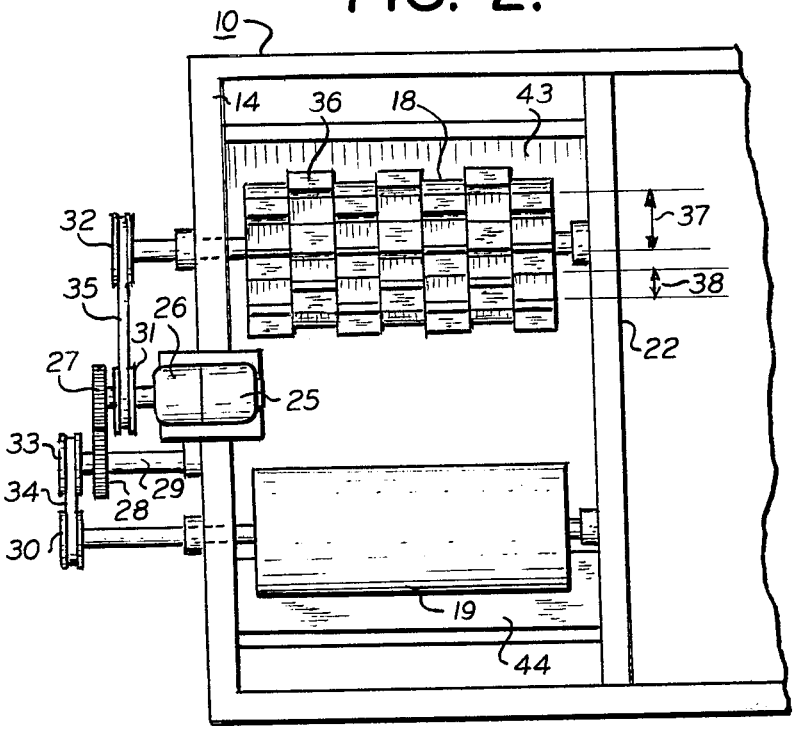
FIG. 2 is a horizontal view of the apparatus for producing stockpileable asphaltic concrete taken along the lines 2—2 of FIG. 1.

Referring to FIG. 2, means for driving vaned projecting drum 18 and dispersing drum 19 in opposite rotational directions is shown, by way of example, as motor 25 with variable speed gear train 26 mounted on the upper edge of coolant tank 10, gears 27 and 28, idle shaft 29, V-belt pulleys 30, 31, 32 and 33 and V-belts 34 and 35. Idle shaft 29 is rotatably mounted in feed-end 14 of coolant tank 10. Gear 27 and pulley 31 are affixed to the shaft of gear train 26. Pulleys 30 and 32 are affixed to the shafts of dispersing drum 19 and vaned projecting drum 18, respectively, while pulley 33 and gear 28 are affixed to idle shaft 29. Gear 27 meshes with gear 28, pulleys 30 and 33 are connected by V-belt 34, and pulleys 31 and 32 are connected by V-belt 35. The overall speed ratio in the preferred embodiment was selected so that vaned projecting drum 18 turns at three times the speed of dispersing drum 19. Accordingly, V-belt pulleys 30, 31, 32 and 33 are all equal in diameter and gear 28 is three times the diameter of gear 27.

Referring more particularly to FIG. 2, vaned projecting drum 18 is shown to have a plurality of vanes 36 affixed, by any conventional means such as welding, to vaned projecting drum 18. In the preferred embodiment, vaned projecting drum 18 and dispersing drum 19 are one foot in diameter and seven feet long. Vanes 36 are one foot long, one-half inch high and three inches wide. Spacings 37 of adjacent vanes 36 in the same row are approximately six inches while offsets 38 between adjacent vanes 36 in adjacent rows are approximately three inches. The circumference of a one foot diameter drum is approximately thirty-seven inches and there are six vanes 36 approximately three inches wide in each row around the circumference of vaned projecting drum 18 accounting for approximately eighteen inches. Thus, the vanes occupy about one-half the surface area of vaned projecting drum 18. Further, as adjacent rows of vanes 36 are offset by approximately three inches, it can be visualized that vaned projecting drum 18 appears to be covered with adjacent offset rows of depressions approximately one foot long, three inches wide and one-half inch deep.

The axes of rotation of vaned projecting drum 18 and dispersing drum 19 in the preferred embodiment are spaced apart by two feet.

Figure 3:
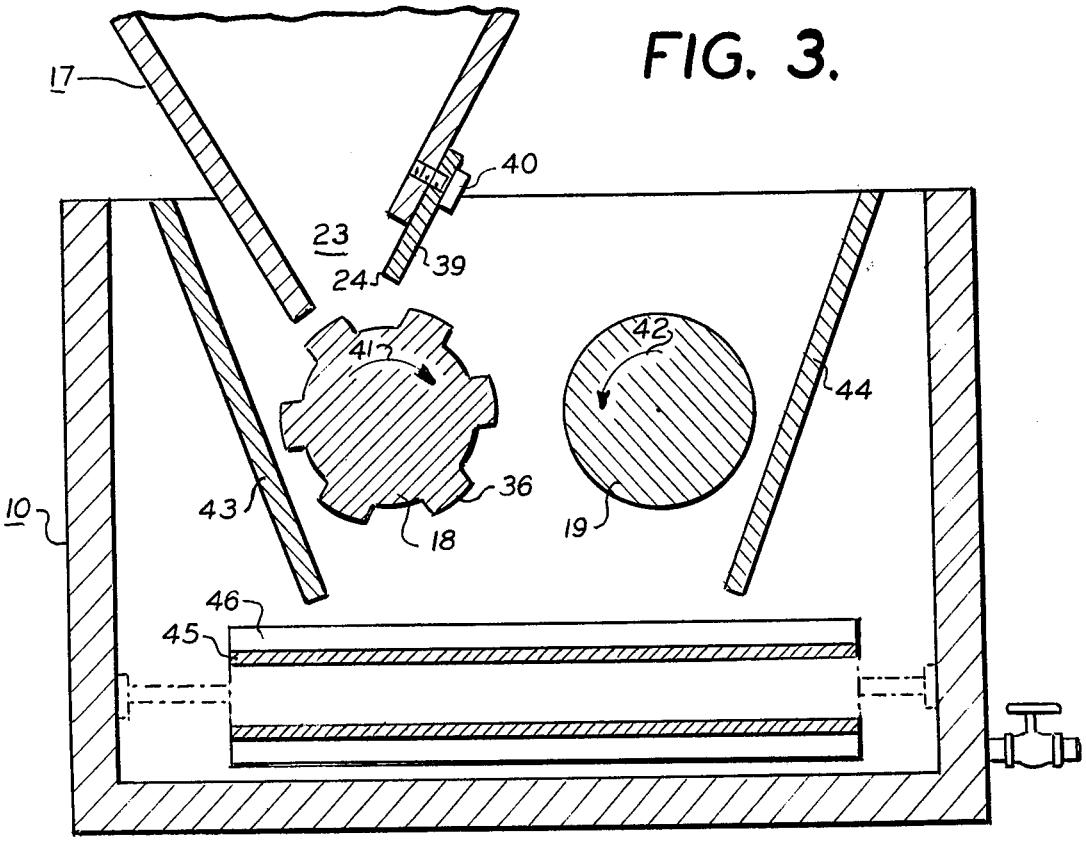
FIG. 3 is a sectional end view of the apparatus for producing stockpileable asphaltic concrete taken along the lines 3—3 in FIG. 1.

Referring to FIG. 3, shearing plate 39 forming one long side of output port 23 can be adjusted so as to permit the spacing between shearing edge 24 and vanes 36 to be varied. Such adjustment may be made by any conventional means, such as screws 40.

Vaned projecting drum 18 is driven in the rotational direction shown by arrow 41 while dispersing drum 19 is driven in the opposite rotational direction shown by arrow 42.

Deflectors 43 and 44 are plates which are supported by and extend between feed-end 14 of coolant tank 10 and cross-support 22. They function to direct the dispersed particles of asphaltic concrete onto endless conveyor 45.

Referring again to FIG. 1, the apparatus of the invention further comprises means for discharging the particles of asphaltic concrete from coolant tank 10, which is shown, by way of example, as endless conveyor 45 and suitable means for driving it. Endless conveyor 45 is equiped with drag plates 46 and is mounted on rollers 47 and 48 at the bottom of feed-end 14 and at the top of discharge-end 15, respectively, of coolant tank 10. Rollers 47 and 48 are rotatably mounted between sides 12 and 13 of coolant tank 10 in such a position that upper belt 49 of endless conveyor 45 travels upwardly from the bottom of feed-end 14 to the top of discharge-end 15.

The drive means for endless conveyor 45 comprises motor 50 mounted on the upper edge of coolant tank 10, V-belt pulley 51 affixed to the shaft of motor 50, V-belt pulley 52 affixed to the shaft of roller 48 and V-belt 53 connecting V-belt pulleys 51 and 52. In the preferred embodiment, upper belt 49 of endless conveyor 45 is driven at a speed of one hundred fifty feet per minute toward discharge-end 15.

Referring to FIG. 1, supply hopper 17 would typically have a ten foot long top edge 54 tapering down to six feet at output port 23. Top side-edge 55 would typically be four feet long tapering down to three inches at output port 23. Output port 23 should not be longer than vaned projecting drum 18.

Coolant tank 10 would typically be thirty feet long, three and one-half feet high and six feet wide. Discharge-end 15 is preferably sloped upwardly and outwardly to facilitate removal of the asphaltic concrete discharged by endless conveyor 45. Apparatus for producing stockpileable asphaltic concrete having the typical dimensions specified above would be expected to yield an output of approximately two tons per minute of such material.

It is anticipated, if the apparatus of this invention is used continuously for an extended period of time, that the hot-mix asphaltic concrete will cause the temperature of coolant bath 11 to rise above 120° F. For such continuous use it would be preferable to incorporate means for reducing the temperature of coolant bath 11. This may be accomplished in any conventional manner. For example, coolant 11 may be continuously added through inlet valve 56 and discharged through outlet valve 57.

Further, referring to FIG. 1, the apparatus of this invention may include means for making the apparatus portable. Such means is shown, by way of example, as wheels 58 rotatably mounted to sides 12 and 13 of coolant tank 10 and tow link 59 affixed, by any conventional means, such as welding, to discharge-end 15 of coolant tank 10.

Coolant bath 11, as used in the preferred embodiment, is water. However, in order to prevent the hot-mix asphaltic concrete from adhering to the apparatus it is recommended that a liquid silicone lubricant be added to the water. This lurbricant will also aid in retarding corrosion. The additive used in the preferred embodiment is a mixture of dimethyl siloxane and methylene chloride manufactured by New York Bronze Powder Inc. and sold under the registered trademark NU-KOTE BRAND. The silicone lubricant in the preferred embodiment is added to the water in the ratio, by volume, of 1:150. If the temperature of coolant bath 11 is being controlled by adding additional water through inlet valve 56 and discharging hot coolant bath 11 through outlet valve 57, it is estimated that for continuous use the coolant bath would be changed about every four hours. This would require approximately ten gallons of lubricant to be added every four hours. The operator will be able to determine when lubricant need be added by observing the degree to which the hot-mix asphaltic concrete tends to adhere to the apparatus.

Any silicone lubricant which unavoidably coats the dispersed particles of asphaltic concrete will not affect its strength. The lubricant is not a cutback agent.

It is believed that the operation of the apparatus of the present invention will be clear from the foregoing description. Briefly, hot-mix asphaltic concrete is fed by means of supply hopper 17 onto vaned projecting drum 18. Vanes 36 project sheets of the hot-mix asphaltic concrete above coolant bath 11 against dispersing drum 19 which is rotating in the opposite direction to that of vaned projecting drum 18 as shown by arrows 41 and 42 in FIG. 3. Due to the rotation of dispersing drum 19, the sheets of hot-mix asphaltic concrete are broken into particles and deflected through coolant bath 11 between deflectors 43 and 44 and are collected on upper belt 49 of endless conveyor 45. Endless conveyor 45, aided by drag plates 46, transports the dispersed particles of asphaltic concrete through coolant bath 11, further cooling such particles, toward discharge-end 15 of coolant tank 10. The discharge-end of endless conveyor 45 extends beyond discharge-end 15 of coolant tank 10. Thus, at its highest point, endless conveyor 45 discharges the processed particles of asphaltic concrete from coolant tank 10.

The clearance between shearing edge 24 and vanes 36 is very important. Its dimension is dependent primarily on the size of the aggregate used in the hot-mix asphaltic concrete and should be set about one-sixteenth of an inch larger than the diameter of the largest aggregate used in the hot-mix asphaltic concrete. The other side of output port 23 parallel to shearing edge 24, which is not adjustable, should also have approximately one-sixteenth of an inch clearance from vanes 36. The size of the aggregate used and the clearance between shearing edge 24 and vanes 36 will determine the size of the stockpileable asphaltic concrete produced. The particles so produced look like small, irregular shaped pieces of coal.

The speed, diameters and spacing between vaned projecting drum 18 and dispersing drum 19 are also very important. In the preferred embodiment it was stated that both drums are one foot in diameter and that their axes of rotation are spaced apart by two feet. It is also stated that in the preferred embodiment both axes of rotation are in the same horizontal plane. The interaction of these parameters is better understood when we consider the function of dispersing drum 19.

Hot-mix asphaltic concrete is projected against dispersing drum 19 causing it to splatter. A portion of the dispersed asphaltic concrete will fall into coolant bath 11, while some will adhere to dispersing drum 19 to be washed off as drum 19 rotates through coolant bath 11. If dispersing drum 19 were stationary the hot-mix asphaltic concrete would tend to create a thick build-up. However, as dispersing drum 19 is rotated the build-up of asphaltic concrete at the moving point of impact on dispersing drum 19 is kept constant and relatively uniform sized particles are formed. Accordingly, the speed of dispersing drum 19 is inversely related to its diameter. The larger the diameter of dispersing drum 19 the slower it need by driven by motor 25. In addition, the faster vaned projecting drum 18 rotates the faster dispersing drum 19 must be rotated. Further, as the spacing between vaned projecting drum 18 and dispersing drum 19 is increased, the faster vaned projecting drum 18 must be rotated so that there will be sufficient force to project the hot-mix asphaltic concrete into contact with dispersing drum 19. Still further, at least some portion of both vaned projecting drum 18 and dispersing drum 19 need be above coolant bath 11. The hot-mix asphaltic concrete must be projected from vaned projecting drum 18 into contact with dispersing drum 19 before it comes into contact with coolant bath 11. Accordingly, the deeper vaned projecting drum 18 and dispersing drum 19 are immersed in coolant bath 11, the faster they must be rotated. In the preferred embodiment vaned projecting drum 18 is rotated at one hundred twenty revolutions per minute, dispersing drum 19 is rotated at forty revolutions per minute and both drums are one-third immersed in coolant bath 11.

The interrelationship between the speed, diameter, spacing and degree of immersion in coolant bath 11 affords a great degree of flexibiltiy in the design of the apparatus of the present invention. It is not necessary that vaned projecting drum 18 have the same diameter as dispersing drum 19 nor need both drums 18 and 19 be in the same horizontal plane.

The depressions created in the surface of vaned projecting drum 18 by the positioning of vanes 36 are offset so that the hot-mix asphaltic concrete projected against dispersing drum 19 will be in small easily dispersed sheets.

The viscosity of the hot-mix asphaltic concrete is also a factor in determining the proper speed for vaned projecting drum 18. As the temperature of the hot-mix asphaltic concrete increases its viscosity decreases and the speed of vaned projecting drum 18 should be reduced. As the temperature of the hot-mix asphaltic concrete decreases the speed of vaned projecting drum 18 should be increased. The speed of vaned projecting drum 18 is controlled by variable speed gear train 26 coupled to motor 25.

While what has been shown and described is believed to be the best mode and preferred embodiment of the invention, modifications and variations can be made therein, as will be clear to those skilled in the art, without departing from the spirit of the invention and consequently, the scope of the invention is intended to be limited solely by the appended claims.

What is claimed is:

1. Apparatus for producing stockpileable asphaltic concrete from hot-mix asphaltic concrete, comprising:

a coolant tank for containing a coolant bath: means for dispersing the hot-mix asphaltic concrete into the coolant tank which comprises:

a supply hopper having an output port with a shearing edge;

a vaned projecting drum rotatably mounted below the output port of the supply hopper so that at least a portion of the projecting drum is above the level of the coolant bath;

a dispersing drum rotatably mounted and spaced from the vaned projecting drum so that at least a portion of the dispersing drum is above the level of the coolant bath and its axis of rotation is substantially parallel with the axis of rotation of the vaned projecting drum; and means for driving the vaned projecting drum and the dispersing drum in opposite rotational directions; and means for discharging the particles of asphaltic concrete from the coolant tank.

2. Apparatus for producing stockpileable asphaltic concrete from hot-mix asphaltic concrete in accordance with claim 1, wherein the shearing edge of the output port of the supply hopper is adjustable so as to permit the clearance between it and the vaned projecting drum to be varied.

3. Apparatus for producing stockpileable asphaltic concrete from hot-mix asphaltic concrete in accordance with claim 1, wherein the vaned projecting drum and the dispersing drum have substantially the same diameters and their axes of rotation are substantially in the same horizontal plane.

4. Apparatus for producing stockpileable asphaltic concrete from hot-mix asphaltic concrete in accordance with claim 1 wherein the drive means rotates the vaned projecting drum at a different angular speed than that of the dispersing drum.

5. Apparatus for producing stockpileable asphaltic concrete from hot-mix asphaltic concrete in accordance with claim 1 which further includes means for reducing the temperature of the coolant bath.

6. Apparatus fo producing stockpileable asphaltic concrete from hot-mix asphaltic concrete in accordance with claim 1 which further includes means for making the apparatus portable.

* * * * *